United States Patent [19]

Vun Kannon, Jr.

[11] 4,247,823

[45] Jan. 27, 1981

[54] LOW NOISE, LOW PHASE SHIFT ANALOG SIGNAL MULTIPLIER

[75] Inventor: Robert S. Vun Kannon, Jr., Phoenix, Ariz.

[73] Assignee: Sperry Corporation, New York, N.Y.

[21] Appl. No.: 23,356

[22] Filed: Mar. 23, 1979

[51] Int. Cl.[3] ..... G06G 7/18; G06G 7/12

[52] U.S. Cl. ..... 328/160; 328/127; 328/144; 328/151; 307/229; 307/234

[58] Field of Search ..... 328/144, 151, 160, 127; 364/703; 307/229, 234, 352

[56] References Cited

U.S. PATENT DOCUMENTS 4,125,811 11/1978 Caron ..... 328/160

*Primary Examiner*—Stanley D. Miller, Jr.
*Assistant Examiner*—B. P. Davis
*Attorney, Agent, or Firm*—Howard P. Terry; Seymour Levine

[57] ABSTRACT

An analog signal multiplier has a pulse former which forms pulses with heights that are proportional to a first input signal and widths that are proportional to a second input signal, integrates the pulses so formed and at the conclusion of the integration, samples the integrated values and resets the integrator and pulse former.

8 Claims, 13 Drawing Figures

LOW NOISE, LOW PHASE SHIFT ANALOG SIGNAL MULTIPLIER

BACKGROUND OF THE INVENTION

1. Field of the Invention

The present invention relates to signal processing and more specifically to signal processing by analog multiplication.

2. Description of the Prior Art

In the present state of the signal processing art, analog multiplication may be accomplished by utilizing such techniques as quarter-square multiplication, triangular averaging multiplication, pulse width/pulse height multiplication, and variable transconductance multiplication. Quarter-square multiplication is based upon the algebraic identity $xy=\frac{1}{4}[(x+y)^2-(x-y)^2]$. Diode networks are used to perform the squaring operation and summing operations are performed with precision resistors. The non-linear characteristics of the diodes and the multiplicity of cross products obtained during the processing produces an output signal with the relatively high noise level. Additionally, these circuits are temperature sensitive and a desired degree of accuracy is difficult to achieve over a wide temperature range.

Multiplication of two signals, x y by triangle averaging is accomplished by adding the triangle wave to the sum of x+y, adding the triangle wave to the difference x−y, rectifying the first sum to retain the positive portion of the wave, rectifying the second sum to retain the negative portion of the wave, individually passing the two rectified sums through lowpass filters and subtracting the sum of the output of the second filter from the output of the first filter to obtain an output voltage that is equal to xy/A, where A is the amplitude of the triangle wave. Since the output is proportional to 1/A, the amplitude of the triangle wave generator must be extremely stable. The lowpass filters provide an integration function and removes a large ripple component which would otherwise appear at the output. This filtering, however, limits the frequency response of the system and introduces phase shifts that are too large for many applications.

In pulse width/pulse height multiplication, the sum of a triangle wave and one of the input signals (e.g., x) is applied to a zero bias comparator, the output of which is a sequence of pulses with a duty cycle determined by the magnitude and polarity of x and a period equal to the period of the triangle wave. This series of pulses controls an electronic switch which is coupled to an amplifier in such a manner that +y is transmitted therethrough when the switch is in the ON state and zero when the switch is in the OFF state. The output signal of the amplifier is coupled to a lowpass filter wherein a waveform is integrated which possesses a duty cycle proportional to x and a magnitude proportional to y resulting in a signal at the output terminal of the filter that is proportional to the product xy. Pulse width-/pulse height multiplication generally suffers from the same problems as triangle averaging multiplication, i.e., lowpass filters are required to reduce ripple and thereby lower the frequency response of the multiplier. Accuracy depends strongly upon the linearity, symmetry and sharpness of the triangle wave, the resistors used in the feedback networks of the amplifiers, which must be precisely matched, and the offset voltage of the comparator. The switching time is a critical error factor and must be small compared with the period of the triangle wave. This places a stringent limit on the upper frequency of the triangle wave and thus on the frequency response of the multiplier.

The variable transconductance of silicon junction semiconductors has been utilized in the prior art to achieve analog multiplications. The transconductance of silicon junction semiconductors, however, varies with temperature which causes the multiplier to be temperature sensitive. Additionally, the non-linear characteristics of the junction are utilized in the multiplicative process which, as stated previously, generates a multiplicity of cross products that contributes to the noise level at the output terminal of the multiplier. Thus, variable transconductance multipliers are both temperature sensitive and noisy.

SUMMARY OF THE INVENTION

A preferred low noise, low phase shift analog multiplier constructed according to the principles of the present invention includes a network for forming a pulse, the height of which is proportional to one input signal and the width of which is proportional to another input signal, an integrator for determining the area within the pulse so formed, and a sample and hold circuit which synchronously samples the signal at the output terminal of the integrator at the end of each integration period. The pulse width and integration period derived therefrom are selected to be very much shorter than the period of the highest frequency in the frequency bands of the two input signals. This establishes input signals that are constant over the integration period. Since the pulse height and width are respectively proportional to the first and second input signals, the output signal of the integrator which is proportional to the area under the pulse is consequently proportional to the product of the two input signals. The signal at the output terminal of the integrator is sampled and held until the next repetition of the process to provide a ripple free output signal proportional to the product of the two input signals. Since the formed pulse cannot be made negative, four quadrant operation requires that a constant be added to the pulse width determining input signal to insure a positive pulse width. With this addition, the output signal of the integrator is the product of the two input signals divided by the constant plus the input signal which controls the pulse height. The latter term is subtracted from the integrator output signal to provide the desired signal which is proportional to the product of the two input signals.

DESCRIPTION OF THE PREFERRED EMBODIMENT

Figure 1:
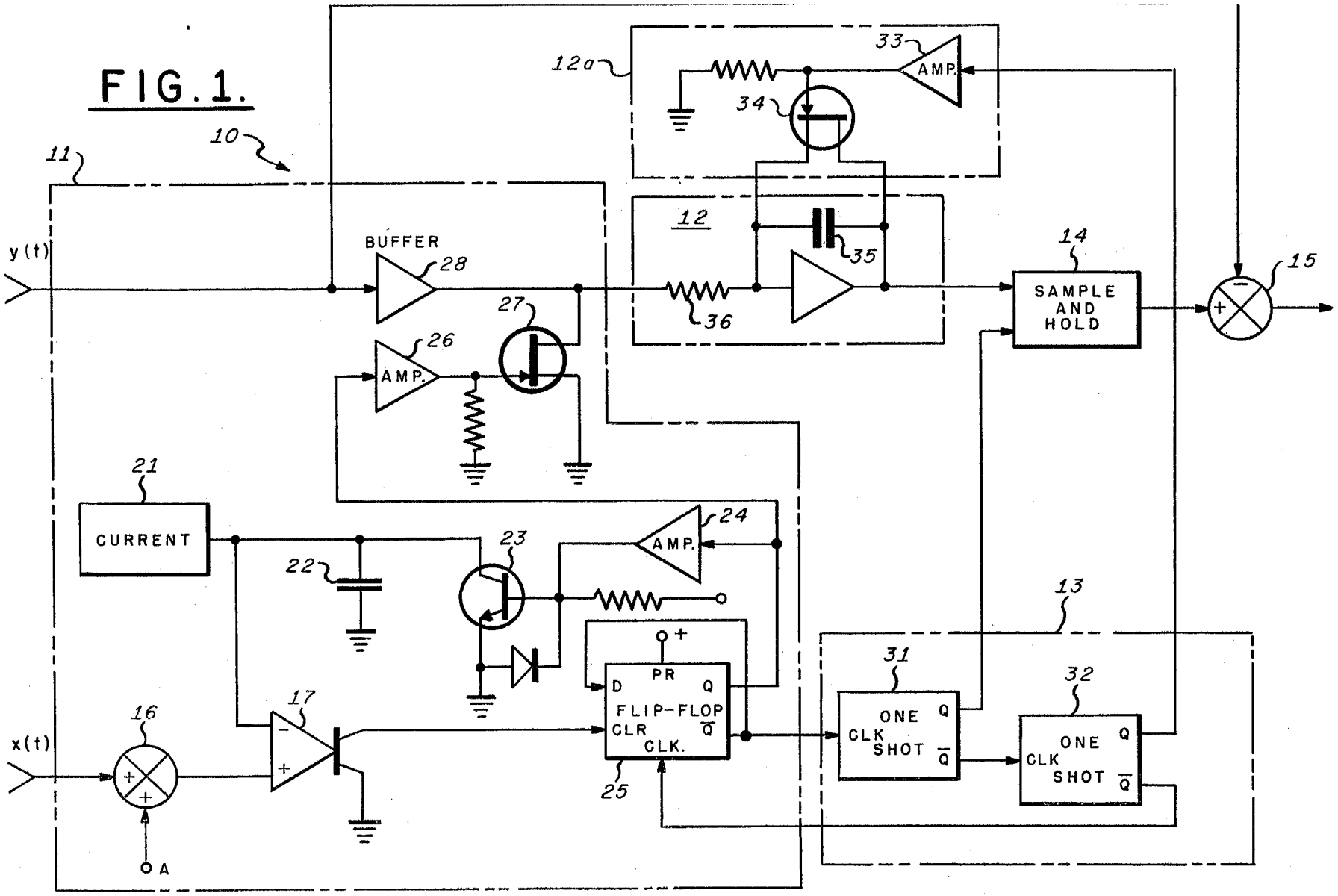
FIG. 1 is a block diagram, partially in schematic form, of a preferred embodiment of the invention.

Referring to FIG. 1, a four quadrant analog multiplier 10 may include a pulse former 11, an integrator 12, an integrator reset **12*a*, a sample and reset timer 13, a sample and hold circuit 14, and a subtraction circuit 15. Pulse former 11 couples pulses to integrator 12 with heights that are proportional to y(t) and widths that are proportional to x(t) +A; where y(t) and x(t) are input signals to the pulse former 11 and A is a constant level signal. y(t) may vary such that $-B \leqq y(t) \leqq B$ and x(t) may vary such that $-A \leqq x(t) \leqq A$. Since the pulses coupled to the integrator 12 cannot be of negative width, it is necessary to add the constant level signal A to x(t) to insure positive pulses from the pulse former 11. Pulses coupled to the integrator 12 are integrated therein and the integrated signals are sampled by the sample and hold circuit 14 on command from the sample and reset timer 13 which is activated by a signal coupled thereto from the pulse former at the completion of each pulse. The sampled signals which contain components of the product x(t)y(t) and y(t), as will be explained subsequently, are coupled to the subtraction network 15** to which the input signal y(t) is also coupled and from which the output signal is x(t)y(t).

Pulse former 11 includes a summing network 16, a comparator 17, a constant current source 21, a capacitor 22, a transistor 23 which acts as an electronic switch, a first amplifier 24, a D-type flip-flop 25, a second amplifier 26, a FET 27 and a buffer 28. The input signal y(t) is coupled to the input terminals of buffer 28, the output terminal of which is coupled to the input terminal of the integrator 12 and to the drain terminal of FET 27, the source terminal of FET 27 is coupled to ground and its gate terminal is coupled to the output terminal of amplifier 26. With a negative level signal coupled to the gate of FET 27 from the amplifier 26, FET 27 is in a non-conducting state and the signal at the output terminal of the buffer 28 is coupled to the input terminal of the integrator 12.

Figures 2A, 2B, 2C, 2D, 2E, 2F, 2G, 2H, 2I, 2J, 2K:
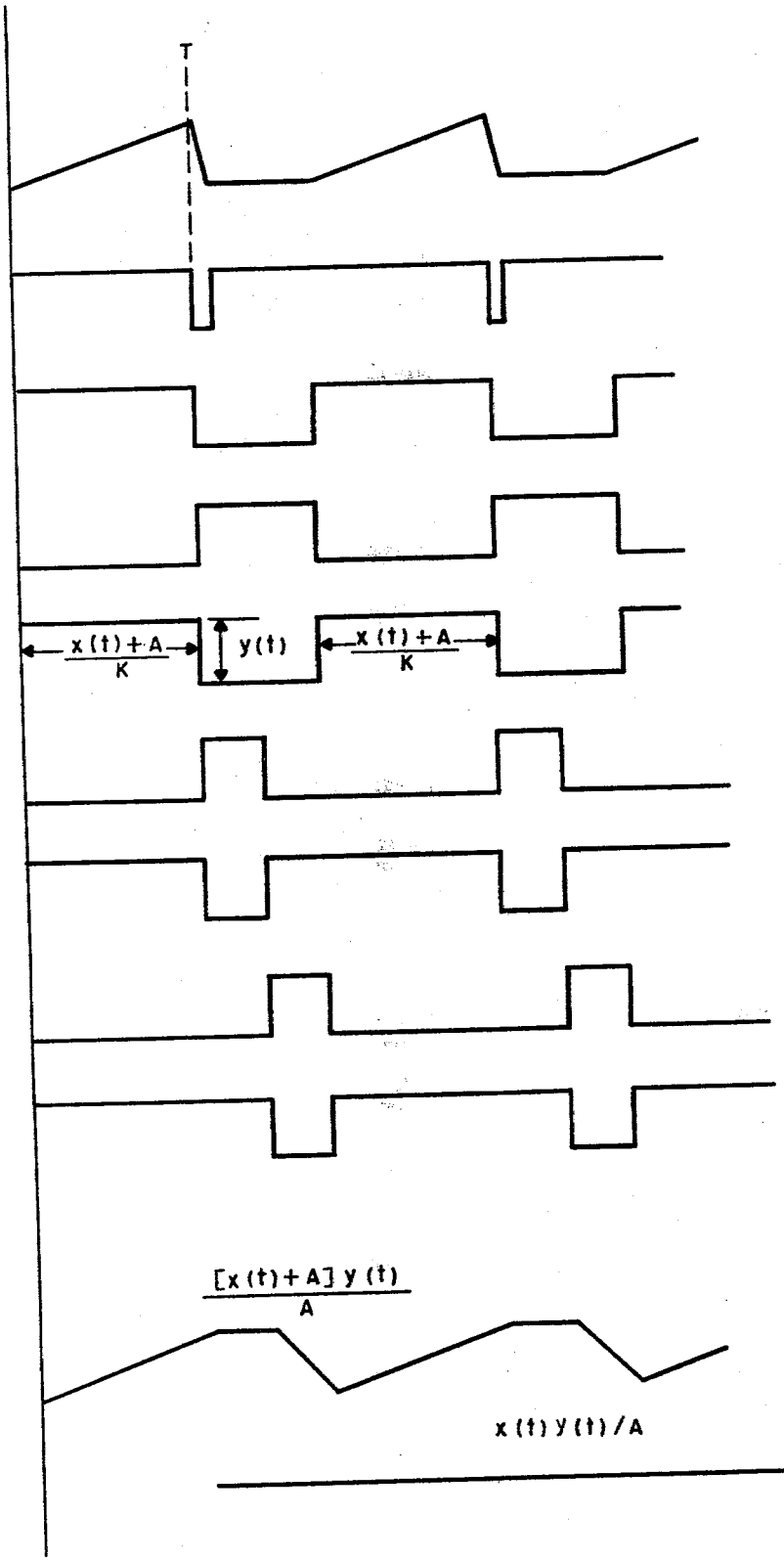
FIGS. 2A through 2K are graphs of waveforms useful in explaining the operation of the embodiment of FIG. 1.

The input signal x(t), where $-A \leqq x(t) \leqq A$, is coupled to the summation circuit 16 to which a constant signal A is also coupled. The output terminal of the summation network 16 is coupled to the positive input terminal of the comparator 17, the negative input terminal of comparator 17 is coupled to the constant current source 21 and to ground via the parallel combination of capacitor 22 and transistor 23. With the signal x(t)+A greater than the voltage $V_c$ across the capacitor 22, a high level signal is coupled from the comparator 17 to the clear terminal of the D-type flip-flop 25. The high level signal at the clear terminal coupled with a high level signal at the preset terminal permits flip-flop 25 to be toggled by low to high transitions of the signals at the clock terminal. Flip-flop 25 is initially set with the Q terminal at a high level state and the $\overline{Q}$ terminal, which is coupled to the D terminal, at a low level state. Capacitor 22 is charged by the constant current source 21 for a time interval that is very much less than the capacitor charging time constant of the capacitor 22—current source 21 combination, resulting in a ramp voltage $V_c(t)=kt$, where $k=I/C$, as indicated in FIG. 2A. When the ramp voltage exceeds the voltage coupled to the positive input terminal of comparator 17 from the summation network 16, which occurs at a time $$T = \frac{x(t) + A}{k},$$

the voltage at the output terminal of the comparator 17 switches from a high level signal to a low level signal. The low level signal coupled to the clear terminal causes flip-flop 25 to clear thereby creating a low level signal at the $\overline{Q}$ terminal. The low level signal at the Q terminal is coupled to amplifier 34 which operates to drive transistor 23 to saturation, thus providing a discharging path for capacitor 22. Discharging capacitor 22 causes the voltage coupled to the negative input terminal of comparator 17 to be below the voltage coupled to the positive input terminal by the summation network 16. The reversal of signal levels at the input terminals of comparator 17 causes the signal at its output terminal to return to a high level, thus creating a pulse of the waveform shown in FIG. 2B.

With the flip-flop 25 in its initial state, the high level signal coupled to the input terminal of amplifier 26 from the Q terminal causes amplifier 26 to maintain FET 27 in a cut-off state. When the low level signal appears at the Q terminal of flip-flop 25, FET 27 is switched by amplifier 26 to the conducting state, thereby grounding the output terminal of buffer 28 and terminating the signal coupled therefrom to the integrator 12. If the time interval T is such that the signal bandwidth of y(t) is much less than 1/T, then y(t) may be considered a constant over the interval and a pulse with height y(t) and width $$\frac{x(t) + A}{k},$$

as shown in FIG. 2E, is coupled to integrator 12. This signal is integrated by integrator 12 and a signal $$S = \frac{(x + A)y}{kRC}$$

is coupled therefrom to the sample and hold circuit 14 where R and C are the values of resistor 36 and capacitor 35, respectively.

As a result of the clearing operation of flip-flop 25, the signal at the $\overline{Q}$ and D terminals are at high levels. The transition from a low level signal to a high level signal clocks a one shot (monostable multivibrator) 31 in the sample and reset timer 13 causing a high level sample command pulse, such as that shown in FIG. 2F, to command the sample and hold circuit 14 to sample the signal at the output terminal of the integrator 12 for the duration of the command pulse, to hold the signal so sampled, and to couple the sampled signal to the subtraction circuit 15. If $kRC=A$, then the signal coupled from the sample and hold circuit 14 to the subtraction circuit 15, is $S'=xy/A+y$. To obtain a signal at the output terminal of the subtraction network 15 that is proportional to xy, the input signal y is also coupled to subtraction network 15 and therein subtracted from the signal of the sample and hold circuit 14, thus resulting in an output signal from the subtraction circuit 15 that is shown in FIG. 2K.

The $\overline{Q}$ terminal of one shot 31 is coupled to the clock terminal of a one shot 32 which is also included in the sample and reset timer 13. The Q terminal of one shot 32 is coupled to the input terminal of an amplifier 33, the output terminal of which is coupled to the gate electrode of a FET 34, the source and drain terminals of which are coupled across the capacitor 35 of the integrator 12. Amplifier 33 and FET 34 are included in the integrator circuit 12*a*. When the signal at the $\overline{Q}$ terminal of one shot 31, the waveform of which is shown in FIG. 2G, undergoes a transition from a low level to a high level, one shot 32 is clocked, creating a high level pulse at the Q terminal and a low level pulse at the $\overline{Q}$ terminal as shown respectively in FIGS. 2H and 2I. The high level pulse coupled from the Q terminal to amplifier 33 causes a signal at the output terminal thereof that switches FET 34 to the conducting state, establishing a short circuit across the capacitor 35, thereby discharging capacitor 35 and resetting the integrator 12. This completes one cycle of the integrator 12, the waveform of which is shown in FIG. 2J. When the pulse at the $\overline{Q}$ terminal of one shot 32 undergoes a low to high transition, flip-flop 25 toggles re-establishing a high level signal at the Q terminal and low level signals at the $\overline{Q}$ and D terminals, as shown in FIGS. 2C and 2D, respectively. The high level signal at the Q terminal of flip-flop 25 is coupled to amplifiers 24 and 26 which respectively cause transistor 23 and FET 27 to cut off thus returning the multiplier to its initial state readily for the next multiplication cycle.

The preceding has described a four quadrant analog mutiplier embodiment of the invention. Those skilled in the art will recognize that a two quadrant multiplier may be realized by eliminating the summation network 16, coupling x(t) directly to the comparator 17, eliminating the subtraction y(t) from the output signal of the sample and hold circuit 14 by the removal of subtraction circuit 15, and coupling the output terminal of the sample and hold circuit 14 to the output terminal of the multiplier 10. Since $-B \leqq y(t) \leqq B$ and $O \leqq x(t) \leqq A$, it is not necessary to add A to x(t) to insure a positive pulse. With this modification, the width of the pulse coupled to the integrator is just x(t) and the integrator-output is just $$\frac{x(t)y(t)}{kRC}.$$

Therefore, it is not necessary to subtract the input signal y(t) from the output of the sample and hold circuit 14. Consequently, the removal of the subtraction circuit 15 and the summation circuit 16 and directly coupling the input signal x(t) to the comparator 17 and the output terminal of the sample and hold circuit 14 to the output terminal of the multiplier 10 transforms the four quadrant multiplier to a two quadrant multiplier.

Figure 3:
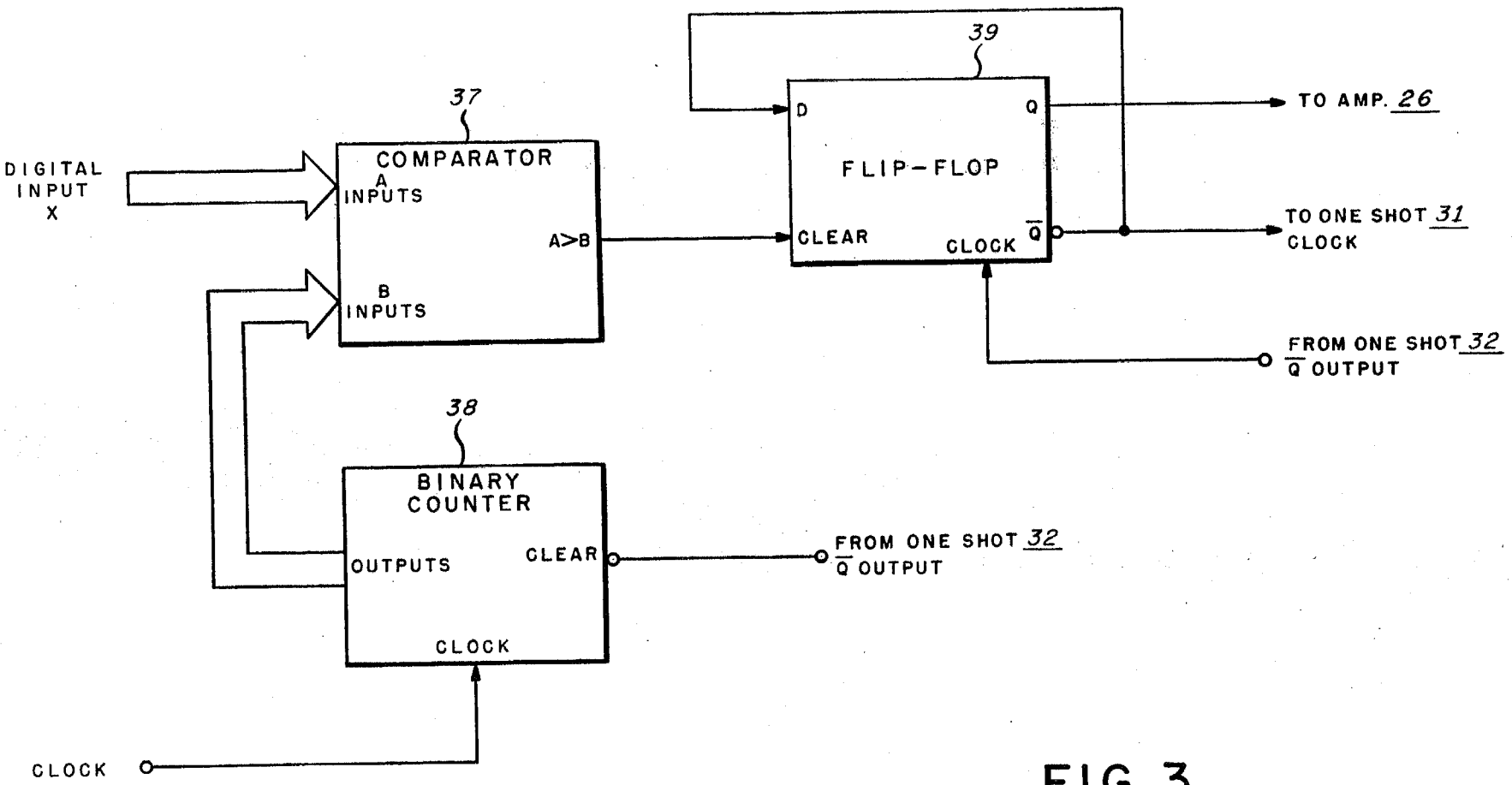
FIG. 3 is a schematic diagram of a digital pulse former useful in an embodiment of the invention.

An alternate implementation of the multiplier can be realized by removing the summing network 16, the comparator 17, current source 21, capacitor 22, transistor 23, amplifier 24, and flip-flop 25 from FIG. 1 and replacing these components with the digital pulse former of FIG. 3. In this implementation of the multiplier, one input (y) and the output remain analog signals while the other input (x) is a digital signal.

The digital pulse former is comprised of a digital comparator 37 whose 'A' inputs are the digital equivalent of the x input to the multiplier, and whose 'B' inputs are coupled from the binary counter 38, and whose output (A>B) is connected to the clear input of the flip-flop 39. The operation mode of the digital comparator 37 is that its output (A>B) is high whenever the digital number at its 'A' inputs is greater than the digital number at the 'B' inputs. The operation of the flip-flop 39 is identical to that of the flip-flop 25 of FIG. 1 which was previously described herein. The binary counter 38 operation is that the binary number represented by its outputs increases by one for each cycle of the clock received at its clock input whenever the signal at its clear input is high. Whenever the signal at the clear input is low, the binary number at the output of this counter is reset to and held at zero.

The digital pulse former is connected to the multiplier of FIG. 1, less said components 16, 17, 21, 22, 23, 24, and 25, in that the Q output of flip-flop 39 is connected to the input of amplifier 26 and the $\overline{Q}$ output of flip-flop 39 is connected to the clock input of one shot 31 and the clock input of flip-flop 39 is connected to the Q output of one shot 32 and the clear input of binary counter 38 is connected to the Q output of one shot 32.

Starting from the time when the binary counter clear input signal goes high, the output of the binary counter 38 increments its value by one for each clock period, TCLK. The output of comparator 37 remains high until the output of the binary counter equals or exceeds the digital input number x, at which time the output of comparator 37 goes low which causes flip-flop 39 to be reset presenting a low at the Q output of flip-flop 39 which, coupled by amplifier 26, causes FET 27 to change to the conducting state, thereby forming a pulse of height y and width x(TCLK) at the input of integrator 12. The output of integrator 12 at this time is then given by yx(TCLK)/(RC), where R and C correspond to resistor 36 and capacitor 35 respectively, which value is present at the analog input of sample and hold 14. At this same time, the resetting of flip-flop 39 resulted in the Q output of flip-flop 39 going high which, being connected to the clock input of one shot 31, causes the Q output of one shot 31 to go high which, being connected to the sample input of sample and hold 14, causes the value at the analog input of sample and hold 14 to be transferred to the output of sample and hold 14 and thereby presented to the positive input of subtraction network 15. Since the value y is being presented to the negative input of subtraction network 15, the output of the multiplier can be given by:

$$xy(TCLK)/RC - y$$

or by $$y[x(TCLK)/RC - 1]$$

Since the range of possible values of the digital input x is constrained to be from zero to some value $x_{max}$, the period of the clock input, TCLK, is now constrained to be $2RC/x_{max}$. Thus, the output of the multiplier is an analog value expressed by $$\frac{y(2x - x_{max})}{x_{max}}$$

which is four quadrant multiplication of the analog input y by a linear operation of the digital input x.

At the end of the pulse output of one shot 31, a pulse output from one shot 32 is initiated which results in resetting integrator 12 via amplifier 33 and FET 34, and the concurrent low-going pulse from the Q output of one shot 32 effects the resetting of binary counter 38 to zero and the toggling of flip-flop 39 to its initial state, thereby completing one cycle of operation of the multiplier and allowing cyclic operation of the multiplier to continue in said fashion.

It will be clear to those skilled in the art that a two quadrant multiplier may be implemented by removing subtraction network 15 and taking the output of sample and hold 14 to be the output of the multiplier and by constraining the period of the input clock, TCLK, to be $RC/x_{max}$, thereby realizing an output which may be expressed by:

$$yx/x_{max}$$

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. A signal mutiplier comprising:

means for forming pulses at an output terminal having heights proportional to signals coupled to a first input means and widths proportional to signals coupled to a second input means;

means coupled to said output terminal of said pulse former means for integrating pulses;

means for sampling and holding integrated values obtained by said integrator means;

means for resetting said integration means; and means responsive to signals received from said pulse former means for generating sample and hold commands to said sample and hold means and reset signals to said integrator reset means and said pulse former means.

2. A signal multiplier in accordance with claim 1 wherein said command and reset means includes:

first monostable multivibrator means triggered by signals received from said pulse former means to provide trigger signals at a first output terminal and to provide sample and hold command signals from a second output terminal to said sample and hold means; and second monostable multivibrator means triggered by said trigger signal at said first output terminal of said first monostable multivibrator means to provide reset signals from a first output terminal to said integrator reset means and to provide reset signals from a second output terminal to said pulse former means.

3. A signal multiplier in accordance with claims 1 or 2 wherein said pulse former means includes:

comparator means having first and second input terminals, said first input terminal coupled to said second input means;

means for generating a current;

capacitor means coupled to be charged by said current generator means to provide a voltage at said second input terminal of said comparator means, said voltage causing a change of state at the output terminal of said comparator means when it achieves a predetermined level relative to said signals coupled to said first input terminal of said comparator means;

toggle means coupled to said output terminal of said comparator means having a predetermined state at a first output terminal and a state complementary to said predetermined state at a second output terminal for changing states existing at said first and second output terminals to complementary states upon the change of state at said output terminal of said comparator means, said second output terminal coupled to said command and reset means whereby upon said change of state at said second output terminal said command and reset means couples reset signals to said integrator reset means, reset signals to said toggle means and sample and hold command signals to said sample and hold means;

first switch means coupled to said capacitor means and to said first output terminal of said toggle means for substantially discharging said capacitor when said state at said first output terminal of said toggle means changes from said predetermined state to the complementary state; and second switch means coupled to said first output terminal of said toggle means and to said output terminal of said pulse former means for substantially terminating signals at said output terminal of said pulse former when said state at said first output terminal of said toggle means changes from said predetermined state to the complementary state, thereby forming pulses with heights proportional to said signals at said first input means and widths proportional to said signals at said second input means.

4. A signal multiplier in accordance with claim 3 further including means coupled to said sample and hold means and said first input means for providing signals representative of the difference between said integrated values sampled and held by said sample and hold means and signals coupled to said first input means.

5. A signal multiplier in accordance with claim 4 wherein said pulse former means includes summation means having a first input terminal coupled to said second input means, an output terminal coupled to said first input terminal of said comparator means and a second input terminal, said summation means for providing a signal to said first input terminal of said comparator means that is representative of the sum of signals coupled to said second input means and said second input terminal of said summation means.

6. A signal multiplier in accordance with claims 1 or 2 wherein said pulse former means includes:

digital comparator means having first and second input terminal means for receiving digital numbers for providing high level signals at output terminal means whenever a digital number coupled to said first input terminal means from said second input means exceeds a digital number coupled to said second input terminal means;

binary counter means having output terminal means coupled to said second input terminal means of said digital comparator means and coupled to receive reset signals from said command and reset means and to receive clock pulses for providing digital numbers at said output terminal means which are representative of the number of pulses received between successive reset signals;

toggle means coupled to said output terminal of said comparator means having a predetermined state at a first output terminal and a state complementary to said predetermined state at a second output terminal for changing states existing at said first and second output terminals to complementary states upon the change of state at said output terminal of said comparator means, said second output terminal coupled to said command reset means whereby upon said change of state at said second output terminal, said command and reset means couples reset signals to said integrator reset means, reset signals to said toggle means and sample and hold command signals to said sample and hold means; and switch means coupled to said first output terminal of said toggle means and to said output terminal of said pulse former means for substantially terminating signals at said output terminal of said pulse former when said state at said first output terminal of said toggle means changes from said predetermined state to the complementary state, thereby forming pulses with heights proportional to said signals at said first input means and widths proportional to said signals at said second input means.

7. A signal multiplier in accordance with claim 3 further including means coupled to said sample and hold means and said first input means for providing signals representative of the difference between said integrated values sampled and held by said sample and hold means and signals coupled to said first input means.

8. A signal multiplier in accordance with claim 4 wherein said pulse former means includes summation means having a first input terminal coupled to said second input means, an output terminal coupled to said first input terminal of said comparator means and a second input terminal, said summation means for providing a signal to said first input terminal of said comparator means that is representative of the sum of signals coupled to said second input means and said second input terminal of said summation means.

* * * * *